US007700882B2

(12) United States Patent
Hakamada

(10) Patent No.: US 7,700,882 B2
(45) Date of Patent: Apr. 20, 2010

(54) CABLE DEVICE

(75) Inventor: Yoshiro Hakamada, Chiba (JP)

(73) Assignee: Sony Corporation, Tokyo (JP)

( * ) Notice: Subject to any disclaimer, the term of this patent is extended or adjusted under 35 U.S.C. 154(b) by 243 days.

(21) Appl. No.: 11/832,177

(22) Filed: Aug. 1, 2007

(65) Prior Publication Data

US 2008/0029299 A1 Feb. 7, 2008

(30) Foreign Application Priority Data

Aug. 7, 2006 (JP) ..... 2006-214854

(51) Int. Cl.
*H01B 7/00* (2006.01)

(52) U.S. Cl. ..... 174/117 R; 174/117 F; 174/117 FF

(58) Field of Classification Search ..... 174/102 R, 174/102 C, 102 SP; 333/236, 237, 239; 343/770, 343/771, 790, 791; 455/523
See application file for complete search history.

(56) References Cited

U.S. PATENT DOCUMENTS 3,106,713 A * 10/1963 Murata et al. ..... 343/770
4,322,699 A * 3/1982 Hildebrand et al. ..... 333/237
4,325,039 A * 4/1982 Allebone ..... 333/237
5,276,413 A * 1/1994 Schulze-Buxloh ..... 333/237
5,291,164 A * 3/1994 Levisse ..... 333/237
5,467,066 A * 11/1995 Schulze-Buxloh ..... 333/237
5,705,967 A * 1/1998 Pirard ..... 333/237
6,292,072 B1 * 9/2001 Bode et al. ..... 333/237

FOREIGN PATENT DOCUMENTS

| | | |
|---|---|---|
| JP | 45-32442 | 12/1970 |
| JP | 57-16107 | 1/1982 |
| JP | 62-103906 | 5/1987 |
| JP | 2000-173828 | 6/2000 |
| JP | 2006-156079 | 6/2006 |

* cited by examiner

*Primary Examiner*—William H Mayo, III
(74) *Attorney, Agent, or Firm*—Oblon, Spivak, McClelland, Maier & Neustadt, L.L.P.

(57) ABSTRACT

The cable device includes a signal line portion electrically connecting an electronic circuit board having an electronic circuit operating at a clock signal having a high frequency with the other electronic circuit board. The cable device further includes a shield portion shielding the signal line portion having a plurality of through-holes located at intervals in the length direction of the signal line portion such that the shield portion includes a plurality of length portions differing in length from the signal line portion.

19 Claims, 8 Drawing Sheets

CABLE DEVICE

CROSS REFERENCES TO RELATED APPLICATIONS

The present invention contains subject matter related to Japanese Patent Application JP 2006-214854 filed in the Japanese Patent Office on Aug. 7, 2006, the entire contents of which being incorporated herein by reference.

BACKGROUND OF THE INVENTION

1. Field of the Invention

The present invention relates to a cable device for electrically connecting an electronic circuit board.

2. Description of the Related Art

Display devices, for example, include an electronic circuit board with an electronic circuit mounted thereon to drive a liquid-crystal display panel for displaying images. The electronic circuit includes a plurality of IC chips, for example, which are used to generate control signals for driving the liquid-crystal display panel and to generate image signals for displaying images on the liquid-crystal panel based on predetermined clock signals.

Since recent electronic circuits employ clock signals having relatively high frequencies (e.g., 10 MHz or more), the electronic circuit board including the electronic circuit is usually shielded with a shield case. In addition, a flat cable electrically connecting the electronic circuit board with other electronic circuit board is shielded by providing a ground layer. As a result, emission of extraneous clock signals having high frequencies can be prevented, which frequently occurs in use of the high frequency clock signals.

As an example for shielding a flat cable, a flexible flat cable has been used. The flat cable includes a transmission signal line pair, such as a differential signal line pair and a digital signal line pair of thin-plate conductors, which is twist-paired to form a common-mode filter to reduce an interfering component extraneously emitted from the transmission signals.

Further, Japanese Unexamined Patent Publication No. 2006-156079 discloses a flexible flat cable that forms a twisted pair by combining an analog video signal line, an audio signal line, or the like susceptible to interfering signals emitted from outside, with a ground signal line located in parallel to such an analog video signal line or an audio signal line, or the like. Further, in the flexible flat cable, a metal shield conductive layer is allowed to adhere to the outer layers of two insulating films to secure the conductor, thereby attaching both ends of the metal shield conductive layer to the ground signal line to shield the entire flexible flat cable. Thus, an interfering component extraneously emitted from a transmission signal may be reduced or an interfering component received on the transmission signal emitted from other circuits close to the flexible flat cable, devices, or the like may be suppressed.

Japanese Unexamined Patent Publication No. 2000-173828 discloses use of a flat cable core for effectively eliminating noises as well as for easily attaching a cable device to the flat cable, detaching the cable device from the flat cable, or for securing the cable device on the flat cable, and for accommodating various sizes of flat cables.

SUMMARY OF THE INVENTION

However, although the aforementioned flat cable is shielded by providing a ground layer on the flat cable, a common-mode noise is extraneously emitted from the surface of the flat cable shielded with the ground layer due to use of a clock signal having a high frequency. The common-mode noise is caused by resonance occurred at a specific frequency due to electromagnetic coupling or capacitive coupling of the ground layer and the sheet metal when the flat cable approaches other sheet metal.

Therefore, the flat cable core has been used for decreasing the common-mode noise.

The flat cable core is allowed to contact the end face of a leg portion of one L-shape divided ferrite core body with the side surface of the leg portion of the other L-shape divided ferrite core body so as to form a closed magnetic path. Thus, the two divided ferrite cores may be assembled.

However, the method using the flat cable core is not so effective for eliminating noises that are emitted due to a clock signal having a high frequency. Further, a method of securing the core on the flat cable may not have easily been realized.

Accordingly, embodiments of the present invention may provide a cable device with which a common-mode noise extraneously emitted from the surface of a flat cable due to a clock signal having a high frequency may be suppressed without adding external members.

According to an embodiment of the present invention, there is provided a cable device including a signal line portion configured to electrically connect an electronic circuit board having an electronic circuit operating at a clock signal having a high frequency to the other electronic circuit board, and a shield portion configured to shield the signal line portion having a plurality of length portions differing in the length from the signal line portion.

According to an embodiment of the present invention, since the shield portion shields the signal line portion so as to have a plurality of length portions differing in the length from the signal line portion, electromagnetic imbalanced intervals in the length direction of the shield portion are dispersed into a plurality of length portions. As a result, emission of a common-mode noise caused by potential difference on the surface of the cable may be suppressed.

Further, since the length of a plurality of length portions of the shield portion is shorter than the length of the whole of the shield portion on which the electromagnetic imbalanced intervals occur, a resonance frequency in the cable is lower than a frequency determined by the size of the cable and hence a resonance frequency of a common-mode noise on the surface of the cable is shifted to other frequency. As a result, a higher harmonic component of a noise in a significant frequency can be prevented from being resonated in the cable. Accordingly, a level of radiated emission may be suppressed.

According to an embodiment of the present invention, dispersing the electromagnetic imbalanced intervals in the length direction on the shield portion into a plurality of length portions may decrease a common-mode noise current generated at the electromagnetic imbalanced intervals on the surface of the cable.

Further, peaks of resonance points of respective resonance frequency may be dispersed so that the peaks are a limit value or below by shifting a resonance point of a resonance frequency. As a result, a resonance frequency of a cable may not overlap with a higher harmonic component of a high clock frequency.

BRIEF DESCRIPTION OF THE DRAWINGS

FIG. 8A shows a front ground layer, FIG. 8B shows a rear ground layer, FIG. 8C shows a cross-section of a ground layer, and FIG. 8D shows a shielded state;

DESCRIPTION OF THE PREFERRED EMBODIMENTS

The embodiments of the present invention will be described below in detail with reference to the drawings.

Figure 1:
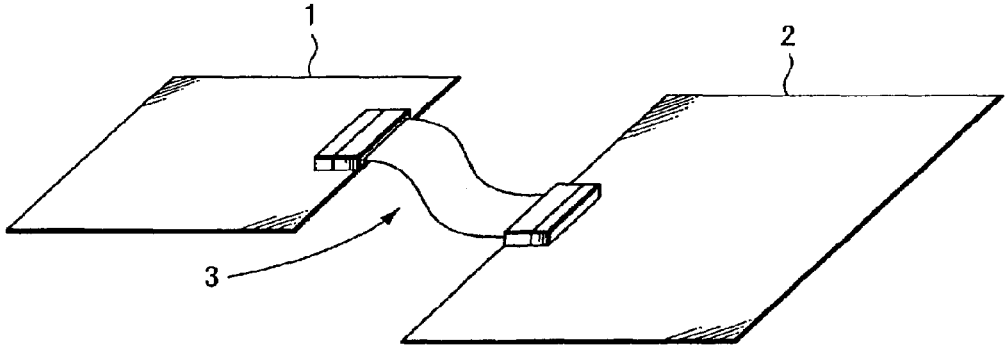
FIG. 1 is a diagram showing a flat cable using a clock signal having a high frequency that connects substrates.
Figure 2:
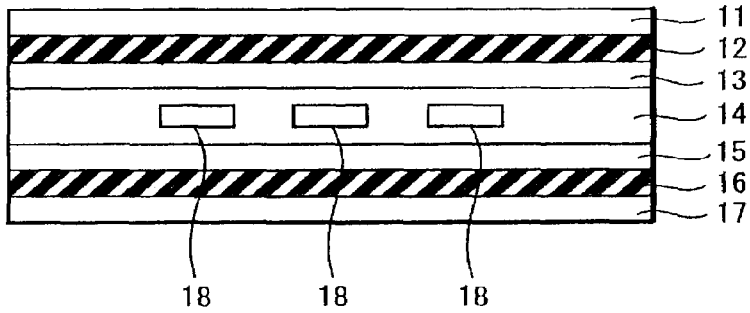
FIG. 2 is a cross-sectional view of a flat cable 3.

FIG. 1 is a diagram showing a flat cable using a high frequency signal as a clock signal which connects substrates. FIG. 2 is a cross-sectional view of a flat cable 3 shown in FIG. 1. The flat cable 3 shown in FIG. 1 may electrically connect an A substrate 1 including an electronic circuit operating at a clock signal having a high frequency (for example, approximately 74 MHz) and a B substrate 2 including other electronic circuit. The flat cable 3 shown in FIG. 1 includes a ground layer formed on one side or both sides of the flat cable 3.

FIG. 2 shows an example of the flat cable 3 which includes the ground layers formed on one side or both sides of the flat cable 3. As shown in FIG. 2, the flat cable 3 includes a adhesive layer 14 to which signal lines 18 are attached and insulating layers 13, 15 insulating the signal lines 18 attached to the adhesive layer 14 from both upper and lower surfaces of the adhesive layer 14. The flat cable 3 further includes ground layers 12, 16 shielding the signal lines 18 adhered and insulated through the adhesive layer 14 from both upper and lower surfaces of the insulating layers 13, 15, and coating layers 11, 17 coating the ground layers 12, 16 from both upper and lower surfaces of the coating layers 11, 17.

Consequently, the signal lines 18 of the flat cable 3 are covered with the ground layers 12, 16 from both upper and lower surfaces and thereby shielding the signal lines 18 in all directions. In addition, the A substrate 1 including the electronic circuit operating at a clock signal having a high frequency may be covered with a shield case (not shown).

However, as mentioned earlier, although the signal lines 18 of the flat cable 3 are covered with the ground layers 12, 16 from both upper and lower surfaces of the ground layers 12, 16, a common-mode noise is extraneously emitted from the surface of the flat cable 3 due to the use of the clock signal having the high frequency. Thus, the flat cable 3 is provided with the following ground layers 12, 16 to reduce the extraneous mission of the common-mode noise.

In the embodiment of the present invention, the ground layers 12, 16 are configured to shield the signal lines 18 such that the ground layers 12, 16 may include a plurality of length portions differing in length from the signal lines 18. Electromagnetic imbalanced intervals on the ground layers 12, 16 in the length direction are dispersed into a plurality of length portions, and hence emission of a common-mode noise caused by potential difference on the surface of the flat cable 3 may be suppressed.

The lengths of a plurality of length portions of the ground layers 12, 16 are shorter than the electromagnetic imbalanced intervals because resonance points of a resonance frequency occurred between the electromagnetic imbalanced intervals are caused to be shifted by changing resonance conditions of a resonance frequency occurred between the electromagnetic imbalanced intervals, as will be described later.

Figure 3:
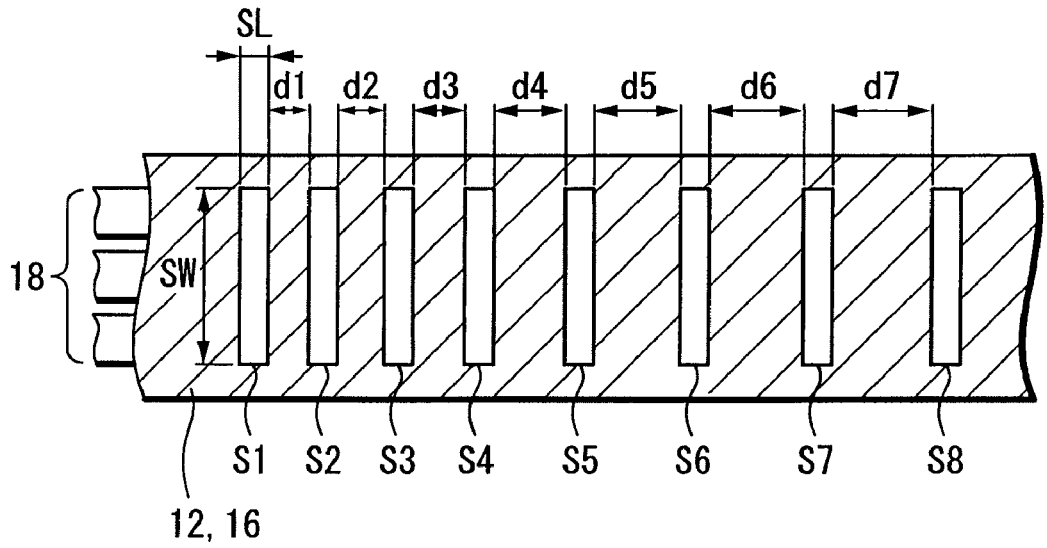
FIG. 3 is a top view of a ground layer.

FIG. 3 is a top view of the ground layer.

As shown in FIG. 3, an electromagnetic noise with a relatively large electromagnetic level and in a relatively large range is emitted from an IC chip on the A substrate 1 to a portion close to the IC chip on the A substrate 1 of the flat cable 3 due to electromagnetic coupling caused by electromagnetic induction action.

In contrast, the above electromagnetic noise with a relatively small electromagnetic level and in a relatively small range is emitted on the B substrate 2 distant from the A substrate 1 of the flat cable 3. Since imbalanced electromagnetic state is occurred on the flat cable 3 between the A substrate 1 and the B substrate 2, that is, a state in which potential difference occurs, a common-mode noise current flows between the electromagnetic imbalanced intervals transmitted on the flat cable 3 between the A substrate 1 and the B substrate 2 to emit extraneous signals from the flat cable 3.

Accordingly, as shown in FIG. 3, the ground layers 12, 16 of the flat cable 3 are provided with a plurality of slits S1, S2, S3, S4, S5, S6, S7, S8 . . . having openings with the width SW and the length SL. These slits S1, S2, S3, S4, S5, S6, S7, S8 . . . are provided at unequal distances d1, d2, d3, d4, d5, d6, d7, d8 . . . in the length direction as shown in FIG. 3. The widths SW of the respective openings in the slits S1, S2, S3, S4, S5, S6, S7, S8 . . . intersect at a right angle with the signal lines 18.

As a consequence, the electromagnetic imbalanced intervals transmitted on the flat cable 3 between the A substrate 1 and the B substrate 2 are divided into a plurality of length portions, which are unequal distances d1, d2, d3, d4, d5, d6, d7, d8 . . . . Accordingly, a common-mode noise caused by potential difference on the surface of the flat cable 3 may be suppressed. The slits S1, S2, S3, S4, S5, S6, S7, S8 . . . are provided at the unequal distances d1, d2, d3, d4, d5, d6, d7, d8 . . . so as to disperse the electromagnetic imbalanced points which cause a common-mode noise having a specific frequency.

Further, since the lengths of a plurality of length portions of the respective unequal distances d1, d2, d3, d4, d5, d6, d7, d8 . . . are shorter than distances between electromagnetic imbalanced intervals on the flat cable 3 due to having a distance between the A substrate 1 and the B substrate 2, a resonance frequency in the flat cable 3 is lower than a frequency determined by the size of the flat cable 3. As a result, a resonance frequency of the common-mode noise on the surface of the flat cable 3 is shifted to other frequency. As a result, a higher harmonic component of a noise with a significant frequency can be prevented from being resonated on the flat cable 3, thereby suppressing a level of radiated emission.

The lengths of a plurality of length portions of the respective unequal distances d1, d2, d3, d4, d5, d6, d7, d8 . . . of the flat cable 3 are selected so as to shift a resonance point of a resonance frequency such that resonance frequencies occurred between the electromagnetic imbalanced intervals on the flat cable 3 may not overlap with high harmonics ($\lambda/2$, $\lambda/4$, . . . where $\lambda$ represents a wavelength of a clock frequency) of clock frequencies of high frequencies on the A substrate 1. Specifically, patterns of the slits S1, S2, S3, S4, S5, S6, S7, S8 . . . are selected by adjusting the lengths of the unequal distances d1, d2, d3, d4, d5, d6, d7, d8 . . . of the flat cable 3.

Although 3 shows an example in which the slits S1, S2, S3, S4, S5, S6, S7, S8 having the openings with the width SW and the length SL are provided at the unequal distances d1, d2, d3, d4, d5, d6, d7, d8 . . . in the length direction as shown in FIG. 3, the present invention is not limited thereto and slits may be provided under other conditions which will follow.

Figure 4:
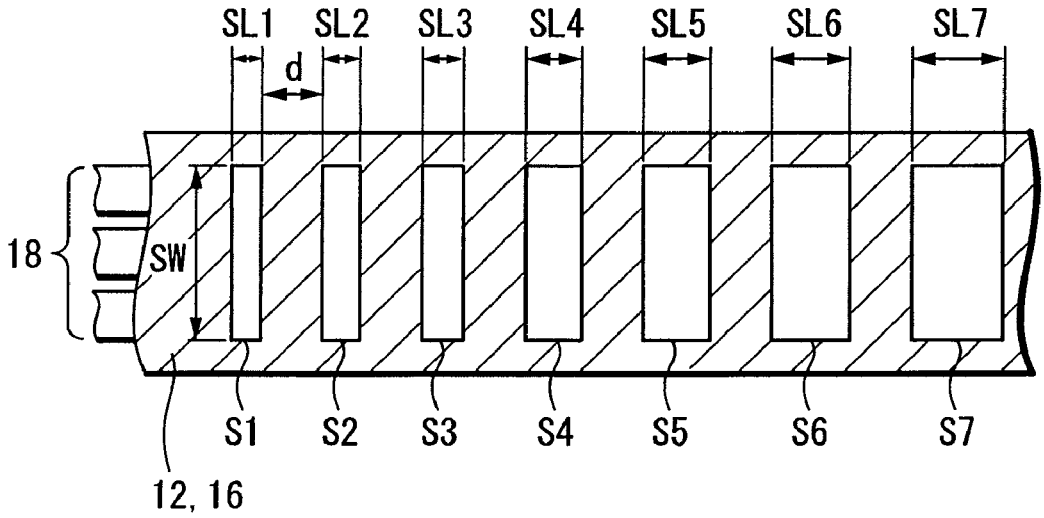
FIG. 4 is a top view showing a modified example 1.

FIG. 4 is a diagram showing a modified example 1.

As shown in FIG. 4, the ground layers 12, 16 of the flat cable 3 are provided with a plurality of slits S1, S2, S3, S4, S5, S6, S7, S8 . . . having openings with the width SW at an equal distance d in the length direction. As shown in FIG. 4, the slits S1, S2, S3, S4, S5, S6, S7, S8 are provided in the length direction so as to include openings SL1, SL2, SL3, SL4, SL5, SL6, SL7, SL8 . . . having unequal lengths. The widths SW of the respective openings in the width direction of the slits S1, S2, S3, S4, S5, S6, S7, S8 . . . intersect at a right angle with the signal lines 18.

As a consequence, the electromagnetic imbalanced intervals occurred on the A substrate 1 and the B substrate 2 on the flat cable 3 are dispersed into a plurality of length portions with the equal distance d at the unit of the openings SL1, SL2, SL3, SL4, SL5, SL6, SL7, SL8 . . . having unequal lengths in the length direction. As a result, emission of the common-mode noise caused by potential difference on the surface of the flat cable 3 may be suppressed. The slits S1, S2, S3, S4, S5, S6, S7, S8 . . . are provided with the openings SL1, SL2, SL3, SL4, SL5, SL6, SL7, SL8 having the unequal lengths in the length direction at an equal distance d so as to disperse the electromagnetic imbalanced point which becomes a cause of a common-mode noise having a specific frequency.

Further, since the lengths of a plurality of length portions with the equal distance d between openings SL1, SL2, SL3, SL4, SL5, SL6, SL7, SL8 having the unequal lengths are shorter than distances between electromagnetic imbalanced intervals transmitted between the A substrate 1 and the B substrate on the flat cable 3, a resonance frequency in the flat cable 3 is lower than a frequency determined by the size of the flat cable 3. As a result, a resonance frequency of the common-mode noise on the surface of the flat cable 3 is shifted to other frequency. Thus, a higher harmonic component of a noise with a significant frequency may be prevented from being resonated on the flat cable 3. As a result, a level of radiated emission may be suppressed.

The lengths of a plurality of length portions with the equal distance d between the openings SL1, SL2, SL3, SL4, SL5, SL6, SL7, SL8 having the respective unequal lengths of the flat cable 3 are selected so that a resonance point of a resonance frequency shifted. As a result, resonance frequencies between the electromagnetic imbalanced intervals on the flat cable 3 may not overlap with high harmonics ($\lambda/2$, $\lambda/4$ . . . where $\lambda$ is a wavelength of a clock frequency) of clock frequencies of high frequencies on the A substrate 1. Specifically, patterns of the slits S1, S2, S3, S4, S5, S6, S7, S8 . . . are selected by adjusting the lengths of the openings SL1, SL2, SL3, SL4, SL5, SL6, SL7, SL8 . . . of the respective unequal lengths of the flat cable 3.

Figure 5:
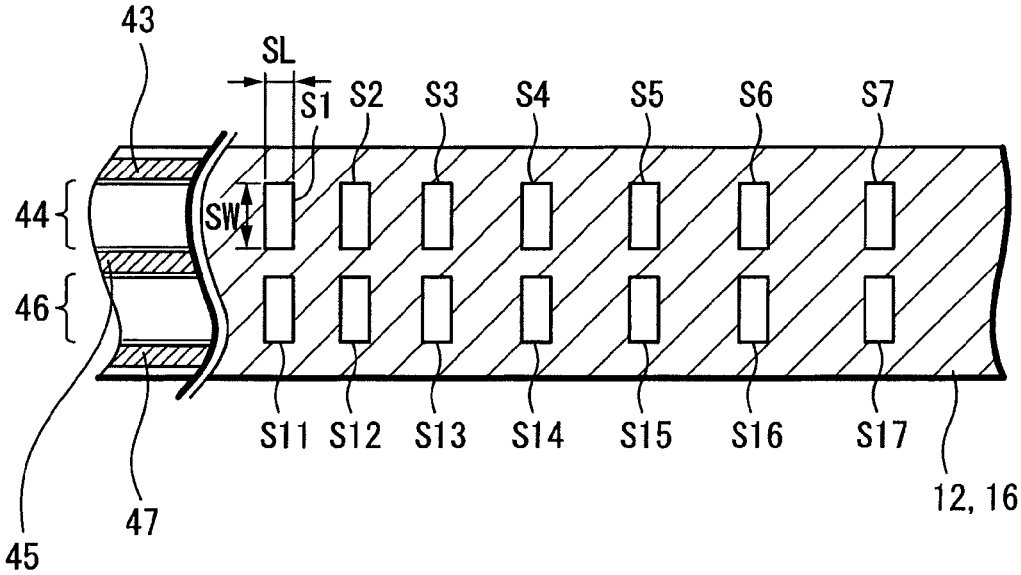
FIG. 5 is a top view showing a modified example 2.

FIG. 5 is a diagram showing a modified example 2.

As shown in FIG. 5, the ground layers 12, 16 of the flat cable 3 are provided with a plurality of slits S1, S2, S3, S4, S5, S6, S7 . . . , slits S11, S12, S13, S14, S15, S16, S17 . . . having openings with the width SW and the length SL. As shown in FIG. 5, the slits S1, S2, S3, S4, S5, S6, S7 . . . , S11, S12, S13, S14, S15, S16, S17 . . . are provided such that the positions of the slits correspond to the positions of the signal lines other than the ground lines when ground lines are provided in addition to the signal lines.

The width SW of the openings provided in the width direction of the slits S1, S2, S3, S4, S5, S6, S7 corresponds to a width of a signal line 44. The width SW of the openings provided in the width direction of the slits S11, S12, S13, S14, S15, S16, S17 includes a width of a signal line 46.

Further, these slits S1, S2, S3, S4, S5, S6, S7 . . . , slits S11, S12, S13, S14, S15, S16, S17 . . . are provided at the unequal distances d1, d2, d3, d4, d5, d6 . . . as shown in FIG. 3.

Consequently, the electromagnetic imbalanced intervals occurred on the signal line 44 on the flat cable 3 between the A substrate 1 and the B substrate 2 are dispersed into a plurality of length portions of unequal distances d1, d2, d3, d4, d5, d6, d7, d8 . . . between the slits S1, S2, S3, S4, S5, S6, S7 . . . . Further, the electromagnetic imbalanced intervals occurred on the signal line 46 on the A substrate 1 and the B substrate 2 on the flat cable 3 are dispersed into a plurality of length portions of unequal distances d1, d2, d3, d4, d5, d6, d7, d8 . . . between the slits S11, S12, S13, S14, S15, S16, S17.

As a result, the emission of the common-mode noise caused by the potential difference on the surface of the flat cable 3 may be suppressed. The slits S1, S2, S3, S4, S5, S5, S7 . . . , slits S11, S12, S13, S14, S15, S16, S17 are provided at the unequal distances d1, d2, d3, d4, d5, d6 . . . so as to disperse the electromagnetic imbalanced intervals which cause the common-mode noise with the specific frequency.

The slits S1, S2, S3, S4, S5, S6, S7 . . . slits S11, S12, S13, S14, S15, S16, S17 . . . may be provided at an equal distance d so as to have the openings SL1, SL2, SL3, SL4, SL5, SL6, SL7 . . . having unequal lengths in the length direction as shown in FIG. 4.

As a consequence, the electromagnetic imbalanced intervals occurred on the signal line 44 on the flat cable 3 between the A substrate 1 and the B substrate 2 are dispersed into a plurality of length portions with the equal distance d between the openings SL1, SL2, SL3, SL4, SL5, SL6, SL7 . . . having unequal lengths in the length direction of the slits S1, S2, S3, S4, S5, S6, S7 . . . . The electromagnetic imbalanced intervals occurred on the signal line 46 on the flat cable 3 between the A substrate 1 and the B substrate 2 are dispersed into a plurality of length portions with the equal distance d between the openings SL1, SL2, SL3, SL4, SL5, SL6, SL7 . . . having unequal lengths in the length direction of the slits S1, S12, S13, S14, S15, S16, S17 . . . .

In consequence, emission of the common-mode noise caused by potential difference on the surface of the flat cable 3 may be suppressed. The openings SL1, SL2, SL3, SL4, SL5, SL6, SL7 of the unequal lengths are provided at an equal distance d in the slits S1, S2, S3, S4, S5, S6, S7 . . . , S11, S12, S13, S14, S15, S16, S17 . . . so as to disperse the electromagnetic imbalanced intervals which is the common-mode noise with the specific frequency.

Figure 6:
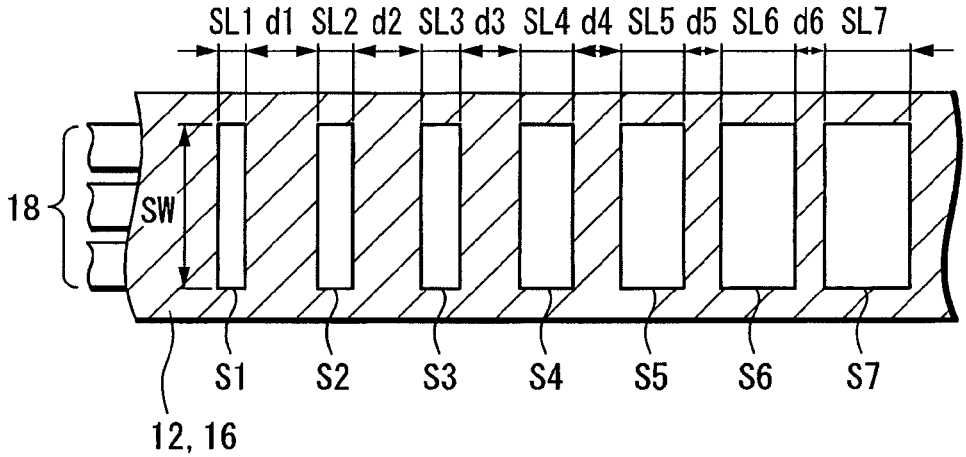
FIG. 6 is a top view showing a modified example 3.

FIG. 6 is a diagram showing a modified example 3.

FIG. 6 shows an arrangement in which the ground layers 12 and 16 are provided with a plurality of slits S1, S3, S4, S5, S6, S7 . . . having openings with the width SW in the width direction as shown in FIG. 3. As shown in FIG. 6, the slits S1, S2, S3, S4, S5, S6, S7 . . . include openings SL1, SL2, SL3, SL4, SL5, SL6, SL7 . . . having unequal lengths in the length direction. The slits are also located at unequal distances d1, d2, d3, d4, d5, d6 . . . in the length direction. The width SW of the openings provided in the width direction of the slits S1, S2, S3, S4, S5, S6, S7 . . . is a width corresponding to the position of the signal lines 18.

As a result, the electromagnetic imbalanced intervals on the flat cable 3 between the A substrate 1 and the B substrate 2 are dispersed into a plurality of length portions between the openings SL1, SL2, SL3, SL4, SL5, SL6, SL7 having unequal lengths in the length direction. As a result, emission of the common-mode noise caused by potential difference on the surface of the flat cable 3 may be suppressed.

The slits S1, S2, S3, S4, S5, S6, S7 . . . are provided with the openings SL1, SL2, SL3, SL4, SL5, SL6, SL7 . . . having the unequal lengths in the length direction at the unequal distances d1, d2, d3, d4, d5, d6 . . . so as to disperse the electromagnetic imbalanced intervals which cause the common-mode noise with the specific frequency.

Since the lengths of a plurality of length portions with the unequal distances d1, d2, d3, d4, d5, d6, d7, d8 . . . between the openings SL1, SL2, SL3, SL4, SL5, SL6, SL7 . . . having the unequal lengths in the length direction are shorter than the distance between the electromagnetic imbalanced intervals transmitted on the flat cable 3 between the A substrate 1 and the B substrate 2, the resonance frequency in the flat cable 3 is lower than the frequency determined by the size of the flat cable 3. As a result, the higher harmonic component of the noise with the significant frequency may be prevented from being resonated in the flat cable 3. As a result, a level of radiated emission may be suppressed.

The lengths of a plurality of length portions of the respective unequal distances d1, d2, d3, d4, d5, d6, d7, d8 . . . between the openings SL1, SL2, SL3, SL4, SL5, SL6, SL7 . . . having unequal lengths in the length direction are selected so as to shift a resonance point of a resonance frequency such that resonance frequencies between the electromagnetic imbalanced intervals on the flat cable 3 may not overlap with high harmonics ($\lambda/2$, $\lambda 4$, . . . where $\lambda$ is a wavelength of a clock frequency) of high-frequency clock frequency on the A substrate 1.

Specifically, patterns of the slits S1, S2, S3, S4, S5, S6, S7, S8 . . . are selected by adjusting the lengths of the unequal distances d1, d2, d3, d4, d5, d6, d7, d8 . . . between the openings SL1, SL2, SL3, SL4, SL5, SL6, SL7 . . . having the unequal lengths in the length direction of the flat cable 3.

Figure 7:
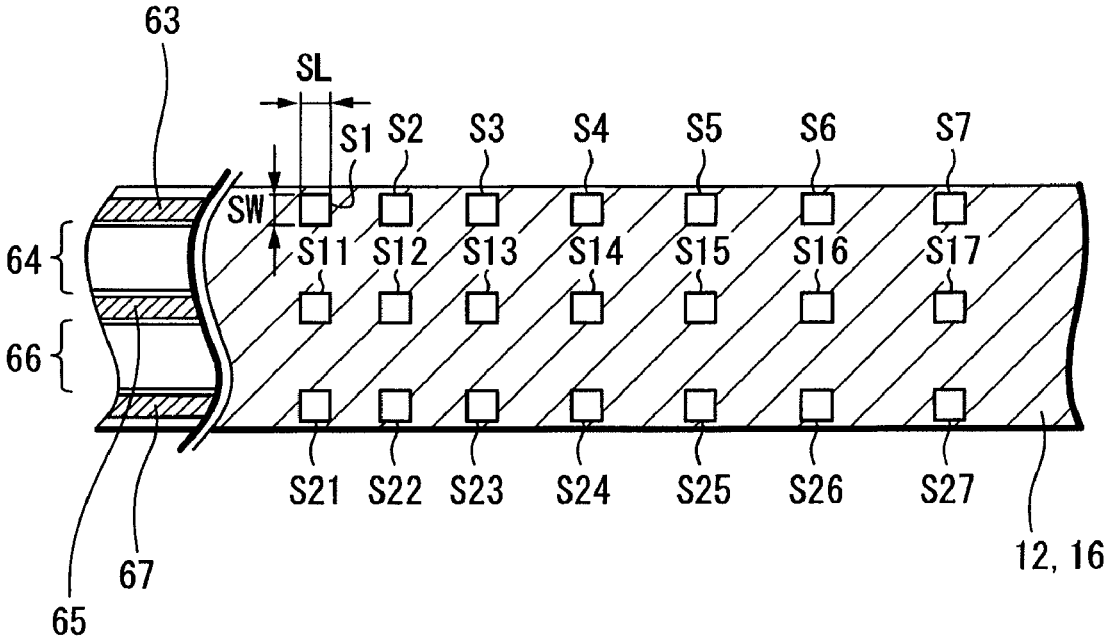
FIG. 7 is a top view showing a modified example 4.

FIG. 7 is a diagram showing a modified example 4.

As shown in FIG. 7, the ground layers 12 and 16 of the flat cable 3 are provided with a plurality of slits S1, S2, S3, S4, S5, S6, S7 . . . , S11, S12, S13, S14, S15, S16, S17 . . . , S21, S22, S23, S24, S25, S26, S27 . . . having openings with the width SW and the length SL. The slits S1, S2, S3, S4, S5, S6, S7 S11, S12, S13, S14, S15, S16, S17 . . . , S21, S22, S23, S24, S25, S26, S27 . . . are provided at the positions corresponding to the ground line as shown in FIG. 7 when the cable device includes a ground line in addition to the signal line.

The width SW of the openings provided in the width directions of the slits S1, S2, S3, S4, S5, S6, S7 is a width corresponding to the position of a ground line 63. Moreover, the width SW of the openings provided in the width direction of the slits S11, S12, S13, S14, S15, S16, S17 is a width corresponding to the position of a ground line 65. In addition, the width SW of the openings provided in the width direction of the slits S21, S22, S23, S24, S25, S26, S27 is a width corresponding to the position of a ground line 67.

The slits S1, S2, S3, S4, S5, S6, S7 . . . , S11, S12, S13, S14, S15, S16, S17 . . . , S21, S22, S23, S24, S25, S26, S27 . . . are provided at the unequal distances d1, d2, d3, d4, d5, d6 . . . as shown in FIGS. 3 and 5.

As a consequence, the electromagnetic imbalanced intervals occurred on the ground line 63 on the flat cable 3 between the A substrate 1 and the B substrate 2 are dispersed into a plurality of length portions with the unequal distances d1, d2, d3, d4, d5, d6, d7, d8 . . . between the slits S1, S2, S3, S4, S5, S6, S7 . . . . Further, the distances between the electromagnetic imbalanced intervals occurred on the ground line 65 on the flat cable 3 between the A substrate 1 and the B substrate 2 are dispersed into a plurality of length portions with the unequal distances d1, d2, d3, d4, d5, d6, d7, d8 . . . between the slits S11, S12, S13, S14, S15, S16, S17 . . . . Further, the electromagnetic imbalanced intervals occurred on the ground line 67 on the flat cable 3 between the A substrate 1 and the B substrate 2 are dispersed into a plurality of length portions with the unequal distances d1, d2, d3, d4, d5, d6, d7, d8 . . . between the slits S21, S22, S23, S24, S25.

Consequently, emission of the common-mode noise caused by potential difference on the surface of the flat cable 3 may be suppressed. The slits S1, S2, S3, S4, S5, S6, S7 . . . , S11, S12, S13, S14, S15, S16, S17 . . . S21, S22, S23, S24, S25, S26, S27 . . . are provided at the unequal distances d1, d2, d3, d4, d5, d6 . . . so as to disperse the electromagnetic imbalanced intervals which cause the common mode noise with the specific frequency.

The slits S1, S2, S3, S4, S5, S6, S7 . . . , S11, S12, S13, S14, S15, S16, S17 . . . S21, S22, S23, S24, S25, S26, S27 . . . may be provided at the equal intervals d such that the slits include the openings SL1, SL2, SL3, SL4, SL5, SL6, SL7 . . . having the unequal lengths in the length direction as shown in FIGS. 4 and 5.

The distances between the electromagnetic imbalanced intervals occurred on the ground line 63 on the flat cable 3 between the A substrate 1 and the B substrate 2 are dispersed into a plurality of length portions with the equal distance d between the openings SL1, SL2, SL3, SL4, SL5, SL6, SL7 . . . having unequal lengths in the length direction of the slits S1, S2, S3, S4, S5, S6, S7 . . . .

Further, the electromagnetic imbalanced intervals occurred on the ground line 65 on the flat cable 3 between the A substrate 1 and the B substrate 2 are dispersed into a plurality of length portions with the equal distance d between the openings SL1, SL2, SL3, SL4, SL5, SL6, SL7 . . . having unequal lengths in the length direction of the slits S11, S12, S13, S14, S15, S16, S17 . . . .

In addition, the distances between the electromagnetic imbalanced intervals occurred on the ground line 67 on the flat cable 3 between the A substrate 1 and the B substrate 2 are dispersed into a plurality of length portions with the equal distance d between the openings SL1, SL2, SL3, SL4, SL5, SL6, SL7 . . . having unequal lengths in the length direction of the slits S21, S22, S23, S24, S25, S26, S27 . . . .

As a result, emission of the common-mode noise caused by potential difference on the surface of the flat cable 3 may be suppressed. The slits S1, S2, S3, S4, S5, S6, S7 . . . are provided with the openings SL1, SL2, SL3, SL4, SL5, SL6, SL7 . . . having the unequal lengths in the length direction at an equal distance d. The slits S11, S12, S13, S14, S15, S16, S17 . . . are provided with the openings SL1, SL2, SL3, SL4, SL5, SL6, SL7 . . . having the unequal lengths in the length direction at an equal distance d. The slits S21, S22, S23, S24, S25, S26, S27 . . . are provided with the openings SL1, SL2, SL3, SL4, SL5, SL6, SL7 . . . having the unequal lengths in the length direction at an equal distance d. As a result, the electromagnetic imbalanced intervals are dispersed into a plurality of length portions with the equal distance d between the openings to reduce the common-mode noise with the specific frequency.

While FIGS. 3 to 7 shows various patterns of the slits provided in the ground layers 12 and 16 of the flat cable 3, the present invention is not limited thereto; and a plurality of ground patterns which cover a plurality of signal lines may be connected by a connecting portion so that length portions of a plurality of ground patterns may be changed.

Figure 8A:
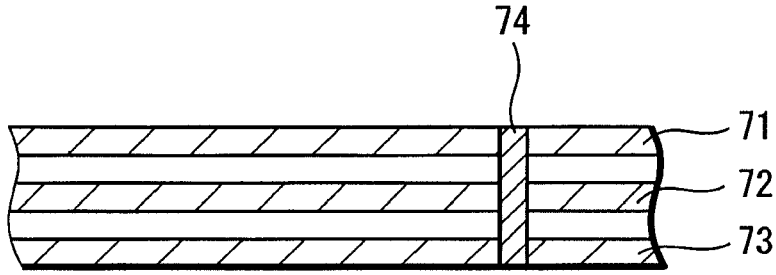
FIGS. 8A to 8D are respectively diagrams showing examples of other ground layers; specifically.
Figure 8B:
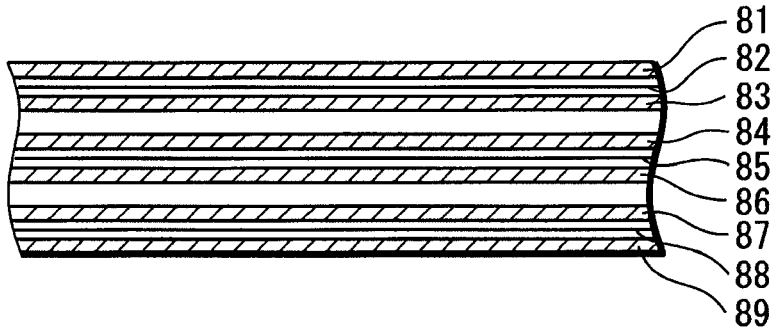
Figure 8C:
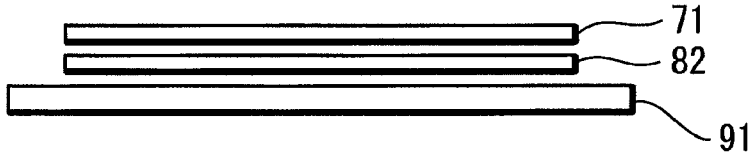
Figure 8D:
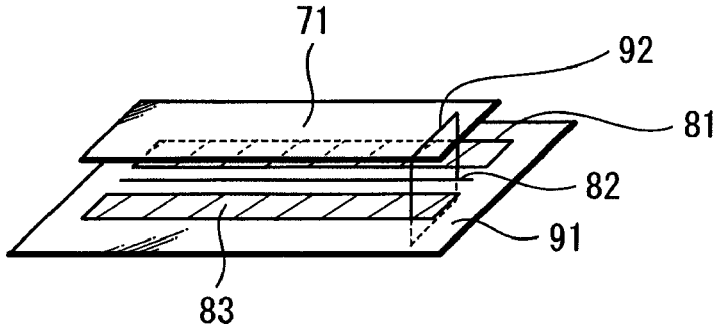

FIGS. 8A to 8D respectively illustrate diagrams showing examples of other ground layers. FIG. 8A is a diagram showing a front ground layer, FIG. 8B is a diagram showing a rear ground layer, FIG. 8C is a diagram showing a cross-section of a ground layer, and FIG. 8D is a diagram showing a shielded state of a ground layer.

As shown in FIG. 8A, in the front ground layer, a plurality of ground patterns 71, 72 and 73 which shield a plurality of signal lines are connected by a connection pattern 74 of an arbitrary direction in the width direction as will be described later. Further, a plurality of connection patterns 74 may be provided in the length direction.

As a result, the electromagnetic imbalanced intervals on the flat cable 3 between the A substrate 1 and the B substrate 2 are dispersed into a plurality of length portions by the connection pattern 74 on a plurality of ground patterns 71, 72 and 73. Emission of the common-mode noise caused by potential difference on the surface of the flat cable 3 may be suppressed. The connection pattern 74 is provided on a plurality of ground patterns 71, 72 and 73 so as to disperse the electromagnetic imbalanced points which cause the common-mode noise with the specific frequency.

As shown in FIG. 8B, the rear ground layer includes a plurality of ground patterns 81, 83, 84, 86, 87 and 89 that shield a plurality of signal lines 82, 85 and 88 so as to sandwich the signal lines 82, 85 and 88 from the side surfaces of the rear side. Further, as shown by a cross-section in FIG. 8C, when a sheet metal 91 is provided at the rearmost layer, the signal line 82 shown in FIG. 8B is shielded from the front and the back with the front ground pattern 71 shown in FIG. 8A and the rear sheet metal 91 shown in FIG. 8C.

Accordingly, as FIG. 8D shows the shielded state, the signal line 82 shown in FIG. 8B is shielded by a tubular shield 92 including the front ground pattern 71 shown in FIG. 8A, a plurality of ground patterns 81 and 83 of the side surface of the back shown in FIG. 8B and the rearmost sheet metal 91 shown in FIG. 8C. FIG. 8D shows the shielded state of the signal line 82 only; which will also apply for other signal lines 85 and 88.

Since the length of a plurality of length portions on a plurality of ground patterns 71, 72 and 73 divided by the connection pattern 74 is shorter than the electromagnetic imbalanced intervals on the flat cable 3 between the A substrate 1 and the B substrate 2, a resonance frequency in the flat cable 3 is lower than a frequency determined by the size of the flat cable 3. As a result, the resonance frequency of the common-mode noise on the surface of the flat cable 3 is shifted to other frequency. As a result, a higher harmonic component of a noise with a significant frequency can be prevented from being resonated on the flat cable 3 and a level of radiated emission may be suppressed.

The length of a plurality of length portions on a plurality of ground patterns 71, 72 and 73 of the flat cable 3 divided by the connection pattern 74 is selected so as to shift a resonance point of a resonance frequency such that resonance frequencies between the electromagnetic imbalanced intervals on the flat cable 3 may not overlap with high harmonics ($\lambda/2$, $\lambda/4$, . . . where $\lambda$ is a wavelength of a clock frequency) of a high-frequency clock frequency on the A substrate 1. Specifically, the pattern of the connection pattern 74 on a plurality of ground patterns 71, 72 and 73 is selected by adjusting the length of the length portion separated by the connection pattern 72 on a plurality of ground patterns 71, 72 and 73 of the flat cable 3.

Figure 9:
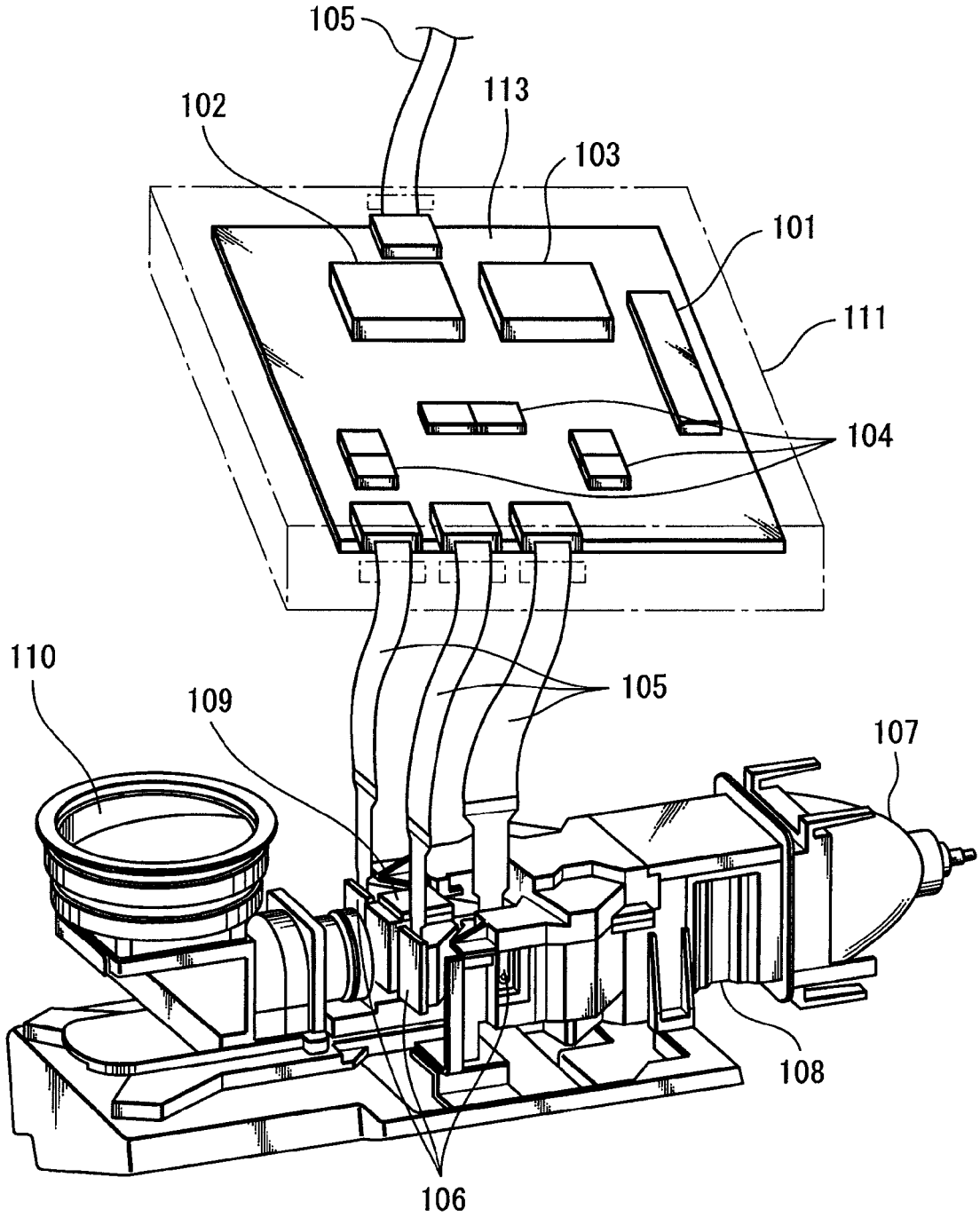
FIG. 9 is a diagram showing an arrangement of a projector apparatus using a shield case.

FIG. 9 is a diagram showing an arrangement of a projector apparatus using a shield case. FIG. 9 shows a portion of a shield case 111 shielding an electronic circuit board 113 in an enlarged-scale rather than the optical system.

The electronic circuit board 113 shielded by the above-mentioned shield case 111 is applied to a projector apparatus which can project images displayed on RGB liquid-crystal panels 106 to a screen (not shown) by driving the RGB liquid-crystal panels 106.

As shown in FIG. 9, light emitted from a light source 107 is passed through a light path 108 and reflected on the RGB liquid-crystal panels 106. Since images are displayed on the RGB liquid-crystal panels 106, the images displayed on the RGB liquid-crystal panels 106 are reflected and synthesized by a cross-dichroic prism 109. The image synthesized by the prism 109 is magnified by a light projecting portion 110 and hence projected on a screen (not shown) located in the upper direction.

Control signals and drive signals for displaying images on the RGB liquid-crystal panels 106 are supplied to the RGB liquid-crystal panels 106 through RGB flat cables 105 from the electronic circuit board 113. The electronic circuit board 113 includes a DC-DC converter 101 for generating a constant power source voltage from a main power supply, a controller 102 operating at a high frequency clock signal (for example, 74 MHz) and performing control, a memory 103 for storing therein various data and a liquid-crystal drive circuit 104 for generating RGB drive signals and control signals.

The electronic circuit board 113 is shielded by the shield case 111. There is a risk that an electromagnetic noise from an IC chip such as the RGB liquid-crystal drive circuit 104, for example, mounted on the electronic circuit board 1113 will be emitted from the flat cable 105 on the assembly mounting surface due to electromagnetic coupling and the like generated by electromagnetic induction action as radiated emission. However, such radiated emission may be suppressed by slits having various patterns on the ground layers 12 and 16 of the flat cable 3 (105 in FIG. 9) shown in FIGS. 3 to 7, or by the connection pattern 74 provided on a plurality of ground patterns 71, 72 and 73 of the flat cable 3 (105 in FIG. 9) as shown in FIG. 8.

Further, it is possible to reduce a noise caused by a high frequency unique to a projector apparatus by shifting a resonance point of a resonance frequency such that the resonance frequency may not overlap with frequencies of clock signals of other power supplies other than those emitted from the electronic circuit board 113 of the projector apparatus.

Figure 10:
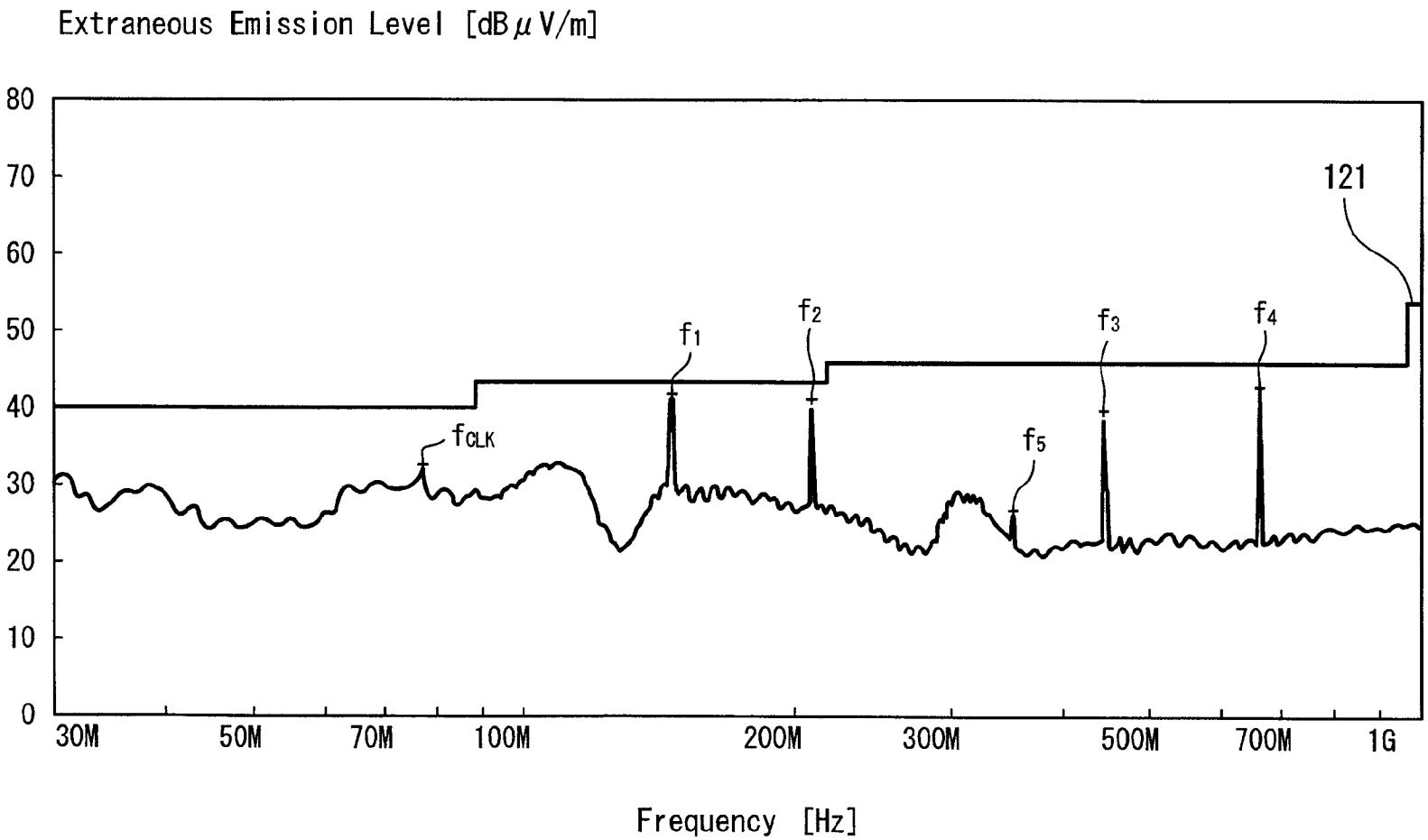
FIG. 10 is a diagram showing a level of radiated emission obtained when a frequency is shifted.
Figure 11:
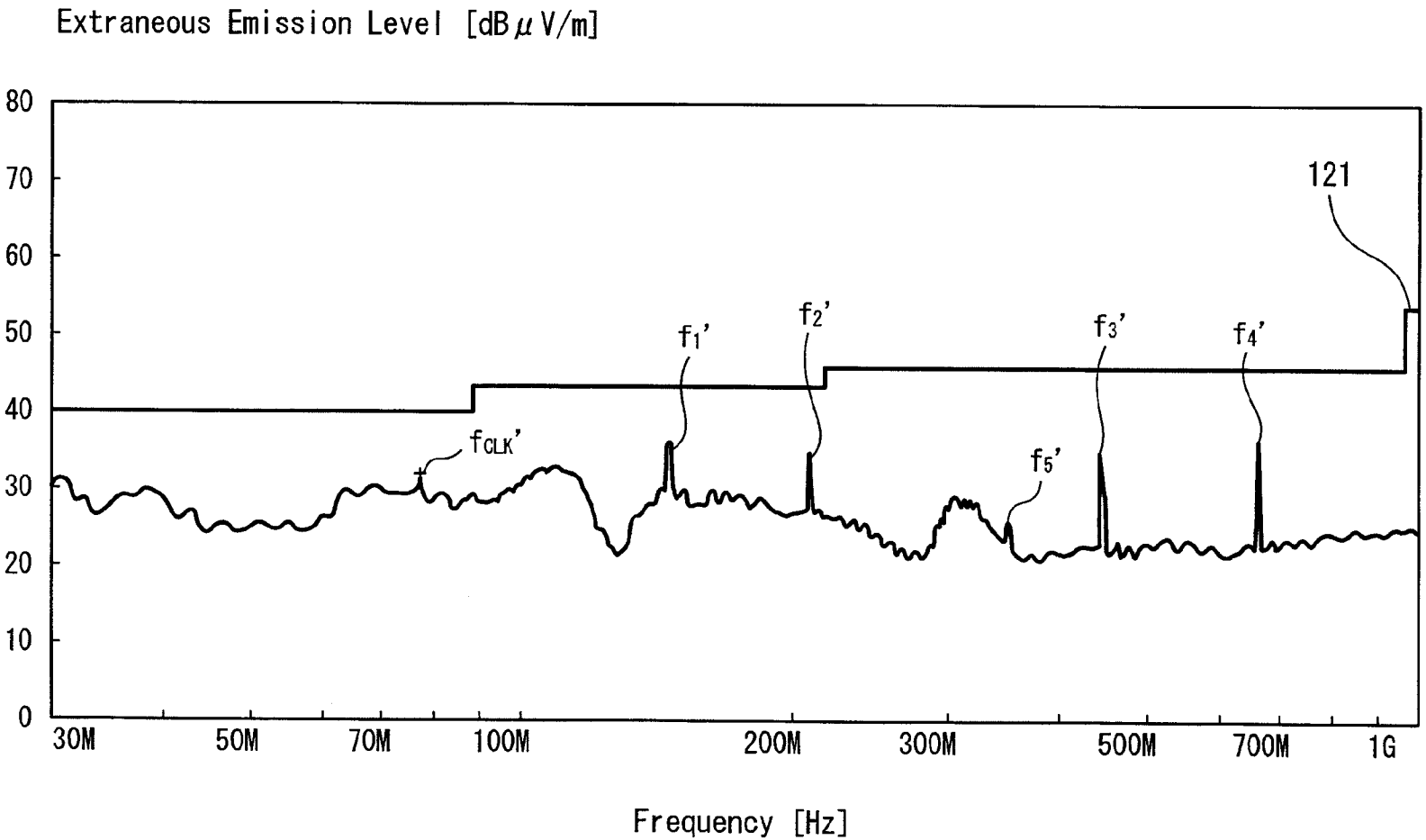
FIG. 11 is a diagram showing a level of radiated emission obtained after a frequency is shifted.

FIGS. 10 and 11 are diagrams showing radiated emission obtained before and after frequencies are shifted.

FIG. 10 schematically shows a manner in which radiated emission is decreased by shifting the resonance frequency of the flat cable 3 when the slits having various patterns are provided between the electromagnetic imbalanced intervals on the ground layers 12 and 16 of the flat cable 3 (105 in FIG. 9) shown in FIGS. 3 to 7 or when the connection pattern 74 is provided between the electromagnetic imbalanced intervals on a plurality of ground patterns 71, 72 and 73 of the flat cable 3 (105 in FIG. 9) as shown in FIG. 8.

FIG. 10 shows radiated emission level obtained when the slits having various patterns are not provided between the electromagnetic imbalanced intervals on the ground layers 12 and 16 of the flat cable 3 (105 in FIG. 9) shown in FIGS. 3 to 7 or when the connection pattern 74 is not provided between the electromagnetic imbalanced intervals on a plurality of ground patterns 71, 72 and 73 of the flat cable 3 (105 in FIG. 9) as shown in FIG. 8. In the example of FIG. 10, a frequency fclk of a high-frequency clock is selected to be about 74 MHz and peaks of radiated emission levels arise at a frequency f1 (148 MHz) of high harmonics twice as high as the frequency fclk, a frequency f2 (222 MHz) of high harmonics three times as high as the frequency fclk, a frequency f3 (444 MHz) of high harmonics six times as high as the frequency fclk and a frequency f4 (666 MHz) of high harmonics nine times as high as this frequency fclk.

The peaks with radiated emission level occur due to a plurality of resonance frequencies determined by the size of the flat cable 3 (105 in FIG. 9) and frequencies of high harmonics of specific multiples of high-frequency clocks are coincident with each other or close to each other. As shown in FIG. 10, high harmonic radiated emission level of the frequencies f1, f2, f3 and f4 are levels close to a limit value 121. Therefore, if radiated emissions emitted from other portions overlap with each other in respective high harmonics, then the radiated emission level exceeds the limit value 121.

Accordingly, if the slits having various patterns are provided between the electromagnetic imbalanced intervals on the ground layers 12 and 16 of the flat cable 3 (105 in FIG. 9) shown in FIGS. 3 to 7. If the connection pattern 74 is provided between the electromagnetic imbalanced intervals on a plurality of ground patterns 71, 72 and 73 of the flat cable 3 (105 in FIG. 9) as shown in FIG. 8, as described above, the resonance frequency of the flat cable 3 (105 in FIG. 9) is lower than the frequency determined by the size of the flat cable 3 (105 in FIG. 9).

Consequently, if the frequency is shifted from approximately f1 and f2 of high harmonics with frequency of 74 MHz that can be efficiently emitted with the length of the flat cable 3 (105 in FIG. 9), for example, to substantially the frequency fclk, high harmonics twice and three times as high as the frequency of the high-frequency clock can be prevented from being efficiently emitted with the length of the flat cable 3 (105 in FIG. 9). As shown in FIG. 11, a level of radiated emission caused by high harmonics twice and three times as high as the high-frequency clock can be lowered. However, although a frequency fclk' is slightly deteriorated, since a level of radiated emission in the frequency fclk is inherently low, even when a level of radiated emission at the frequency fclk' is increased, an amount of such increased level is small so that the frequency fclk' is sufficiently deviated from the limit value 121. Therefore, even when other radiated emissions occur simultaneously, a level of radiated emission can be prevented from exceeding the limit value 121.

In other high harmonics of frequencies six times and nine times as high as the frequency of the high frequency clock, the high harmonics are shifted from approximately f3 and f4 of high harmonics with frequency of 74 MHz that can be efficiently emitted with the length of the flat cable 3 (105 in FIG. 9), for example, to the frequency close to f5, high harmonics six times and nine times as high as the frequency of the high-frequency clock can be prevented from being efficiently emitted with the length of the flat cable 3 (105 in FIG. 9). Thus, as shown in FIG. 11, a level of radiated emission caused by high harmonics six times and nine times as high as the high-frequency clock can be lowered. However, although a frequency f5' (370 MHz) of high harmonics of five times as high as the frequency of the high-frequency clock is slightly deteriorated, since a level of radiated emission in the frequency f5 is inherently low, even when a level of radiated emission at the frequency f5' is increased, an amount of such increased level is small so that the frequency f5' is sufficiently deviated from the limit value 121. Therefore, even when other radiated emissions occur simultaneously, a level of radiated emission can be prevented from exceeding the limit value 121.

The present invention is not limited to the above-mentioned respective embodiments and it is needless to say that the arrangement of the present invention can be properly changed without departing from the gist of the present invention.

It should be understood by those skilled in the art that various modifications, combinations, sub-combinations and alterations may occur depending on design requirements and other factors insofar as they are within the scope of the appended claims or the equivalents thereof.

What is claimed is:

1. A cable device comprising:

a signal line portion configured to electrically connect an electronic circuit board including an electronic circuit operating at a clock signal having a high frequency with the other electronic circuit board, and a shield portion configured to shield the signal line portion having a plurality of slits located at intervals in the length direction of the signal line portion such that the shield portion includes a plurality of length portions differing in length from the signal line portion, wherein said slits are rectangular, which have the same width as said signal line portion.

2. A cable device according to claim 1, wherein the shield portion is arranged on one side or both sides of the signal line portion in thin plate form.

3. A cable device according to claim 2, wherein the slits are provided at unequal intervals in the length direction of the signal line portion.

4. A cable device according to claim 2, wherein the slits have unequal lengths in the length direction of the signal line portion.

5. A cable device according to claim 2, wherein the slits are provided such that a position of the slit corresponds to a position of the signal line portion when the signal line portion includes a signal transmission signal line and a ground level transmission ground line.

6. A cable device according to claim 2, wherein the slits are provided at unequal intervals in the length direction of the signal line portion and the slits have unequal lengths in the length direction of the signal line portion.

7. A cable device according to claim 2, wherein in a length direction of the signal line, the distances between the slits extend or decrease in order.

8. A cable device according to claim 7, wherein said slits are provided such that a position of the slit corresponds to a position of a ground level transmission ground line in said signal line portion, which includes a signal transmission signal line and said ground level transmission ground line.

9. A cable device according to claim 7, wherein said slits are provided such that a position of the slit corresponds to a signal transmission signal line in said signal line portion, which includes a signal transmission signal line and said ground level transmission ground line.

10. A cable device according to claim 2, wherein said slits are provided at equal intervals in a length direction of the signal line portion, and lengths of the slits extend in the length direction of the signal line.

11. A cable device according to claim 10, wherein said slits are provided such that a position of the slit corresponds to a position of a ground level transmission ground line in said signal line portion, which includes a signal transmission signal line and said ground level transmission ground line.

12. A cable device according to claim 10, wherein said slits are provided such that a position of the slit corresponds to signal transmission signal line in said signal line portion, which includes a signal transmission Signal line and said ground level transmission ground line.

13. A cable device according to claim 2, wherein said slits are provided such that distances between the slits decrease in order, while lengths of the slits extend in a length direction of the signal line.

14. A cable device according to claim 13, wherein said slits are provided such that a position of the slit corresponds to a position of a ground level transmission ground line in said signal line portion, which includes a signal transmission signal line and said ground level transmission ground line.

15. A cable device according to claim 13, wherein said slits are provided such that a position of the slit corresponds to signal transmission signal line in said signal line portion, which includes a signal transmission signal line and said ground level transmission ground line.

16. A cable device according to claim 1, wherein the shield portion is arranged in a tubular form so as to shield a plurality of signal lines included in the signal line portion and the shield portion includes a connection portion to connect a tubular portion which shields a plurality of signal lines in the width direction.

17. A cable device according to claim 1, wherein at least two ground layers are included in said shield portion.

18. A cable device according to claim 17, wherein a connection pattern is provided on a plurality of ground layers.

19. A cable device comprising:

a signal line portion configured to electrically connect an electronic circuit board including an electronic circuit operating at a clock signal having a high frequency with the other electronic circuit board; and a shield portion configured to shield the signal line portion having a plurality of slits located at intervals in the length direction of the signal line portion such that the shield portion includes a plurality of length portions differing in length from the signal line portion, wherein said signal line portion includes a ground line portion, wherein said slits are provided such that a position of the slit corresponds to a position of said ground line portion, wherein said slits are rectangular, which have the same width as said signal line portion.

* * * * *